US007451919B2

(12) United States Patent
Savage

(10) Patent No.: US 7,451,919 B2
(45) Date of Patent: Nov. 18, 2008

(54) SELF-SERVICE TERMINAL

(75) Inventor: John G. Savage, Fife (GB)

(73) Assignee: NCR Corporation, Dayton, OH (US)

( * ) Notice: Subject to any disclaimer, the term of this patent is extended or adjusted under 35 U.S.C. 154(b) by 467 days.

(21) Appl. No.: 11/082,533

(22) Filed: Mar. 17, 2005

(65) Prior Publication Data

US 2005/0205675 A1 Sep. 22, 2005

(30) Foreign Application Priority Data

Mar. 18, 2004 (GB) ..... 0406105.7

(51) Int. Cl.
*G07F 19/00* (2006.01)

(52) U.S. Cl. ..... 235/379; 902/2

(58) Field of Classification Search ..... 235/379; 902/2, 9, 16

See application file for complete search history.

(56) References Cited

U.S. PATENT DOCUMENTS

| | | | | |
|---|---|---|---|---|
| 5,010,238 | A | 4/1991 | Kadono et al. | |
| 5,091,713 | A | 2/1992 | Horne et al. | |
| 5,726,430 | A * | 3/1998 | Ruggirello | 235/379 |
| 6,539,361 | B1 | 3/2003 | Richards et al. | |
| 6,676,018 | B1 | 1/2004 | Trelawney et al. | |
| 7,206,938 | B2 * | 4/2007 | Bender et al. | 713/186 |
| 2003/0009426 | A1 | 1/2003 | Ruiz-Sanchez | |
| 2004/0016796 | A1 | 1/2004 | Hanna et al. | |

FOREIGN PATENT DOCUMENTS

| | | | |
|---|---|---|---|
| EP | 0 580 297 | A3 | 1/1994 |
| EP | 0 977 163 | A2 | 2/2000 |
| GB | 2 238 152 | A | 5/1991 |
| WO | WO 02/25613 | A2 | 3/2002 |

* cited by examiner

*Primary Examiner*—Karl D. Frech
(74) *Attorney, Agent, or Firm*—Michael Chan

(57) ABSTRACT

A self-service terminal (10) comprising a plurality of components associated with a valuable media, such as a card reader (28) or cash dispenser (30). Each component includes or is associated with one or more sensors for detecting potentially fraudulent activity and a component agent (34) for generating a warning signal in the event that such activity is detected. Also provided is a higher level agent (38) that is operable to receive warning signals from the component agents (34), and use the received signals to identify potentially fraudulent activity. By providing a hierarchy of fraud detection agents (34,38), the likelihood of a fraud being successfully detected is improved.

14 Claims, 3 Drawing Sheets

SELF-SERVICE TERMINAL

BACKGROUND OF THE INVENTION

The present invention relates to a self-service terminal, such as an automated teller machine (ATM), and a network of such terminals.

Self-service terminals often contain valuable media, such as cash or vouchers. Because of this, ATMs and the like can be targets for fraud. In an attempt to prevent this happening, many ATMs include fraud detection systems. For example in one known system, some components of the machine are operable to monitor certain physical conditions and send signals to a remote host in the event that a potential fraud condition is identified. The host can then take remedial action if necessary, such as disabling the machine so that it cannot be used. Whilst this technique can be useful, a problem is that it is not very sensitive, which means that machines can in some circumstances be shut down unnecessarily. In addition, this technique places a significant processing burden on the host.

SUMMARY OF THE INVENTION

An object of the present invention is to provide an improved solution for fraud detection in self-service terminals.

According to one aspect of the invention, there is provided a self-service terminal, for example an automated teller machine, comprising:

a plurality of components each including or being associated with detecting means for detecting one or more pre-determined conditions of the component;

a plurality of component level software agents, each associated with one of the components and being operable to generate a condition signal in response to the detecting means detecting the pre-determined condition, and a higher level software agent operable to receive condition signals from the component level agents and use these to detect or provide an assessment of potentially fraudulent activity.

By component, it is meant any hardware or software component or device that is included in the terminal, such as a card reader or data entry input, for example a keypad, or a control application.

In use, when a component agent identifies an unusual condition that may be indicative of a potential fraud, it exposes this to the higher-level software agent. Because this higher-level agent is operable to gather information from a range of component agents, a more accurate assessment of fraud activity can be obtained. In this way, there is provided a terminal-based hierarchical approach to managing and detecting fraud, which is fast and effective.

Preferably, a hierarchy of higher-level agents is provided, each level in the hierarchy comprising one or more additional agents operable to use information from lower level agents to provide an improved assessment of the likelihood of fraudulent activity. In practice, the hierarchy can continue to as many levels as required to refine and classify fraud attempts to a desired accuracy. Optionally, the self-service terminal may include a consumer application that is operable to decide which agent levels to react to.

Each component level software agent may be associated with a store or database that includes an indication of the likelihood of fraudulent activity based on one or more received condition signals.

Each higher-level software agent may be associated with a store or database that includes an indication of the likelihood of fraudulent activity based on one or more signals received from lower level agents.

Preferably, each agent has a dedicated function and is focused on a specific area of fraud detection.

Preferably, the detecting means comprise one or more sensors.

According to another aspect of the present invention, there is provided a self-service terminal, for example an automated teller machine, comprising: a plurality of components, each including or being associated with one or more detecting means for detecting potentially fraudulent activity; a plurality of means for generating a warning signal in response to the means for detecting potentially fraudulent activity, each being associated with one of the plurality of components, and means for receiving warning signals and using the plurality of received signals to detect potentially fraudulent activity.

Preferably, the means for generating the warning signal comprise a component level software agent. Each component level software agent may be associated with a store or database that includes an indication of the likelihood of fraudulent activity based on one or more received sensor conditions or readings.

Preferably, the means for receiving the warning signals and using those signals comprises a software agent.

Optionally, one or more additional software agents are provided, each being operable to use information from a plurality of lower level component agents to refine and improve fraud detection.

Preferably, the detecting means comprise one or more sensors.

BRIEF DESCRIPTION OF THE DRAWINGS

Various aspects of the invention will now be described by way of example and with reference to the accompanying drawings, of which.

DETAILED DESCRIPTION

Figure 1:
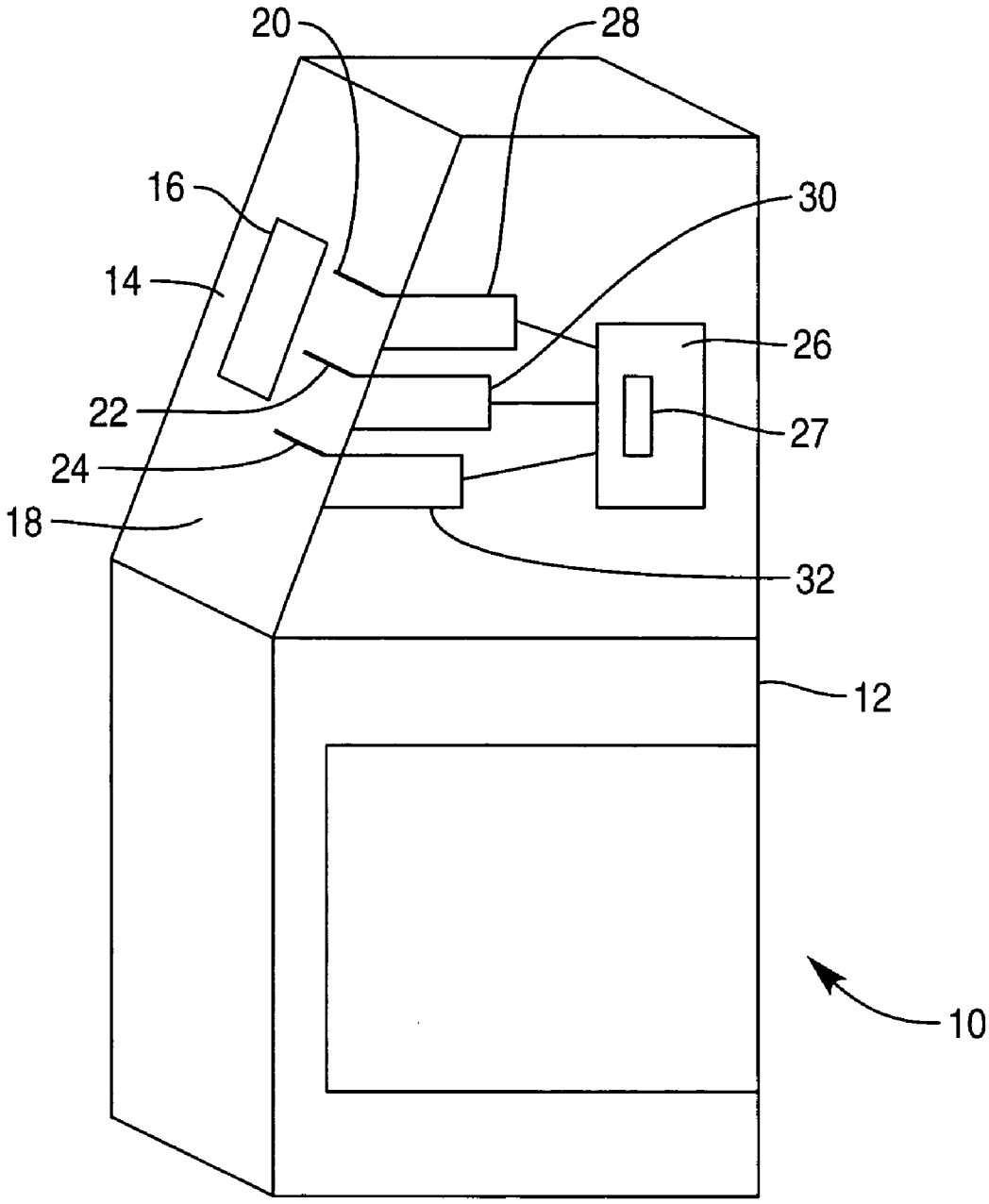
FIG. 1 is a schematic diagram of an automated teller machine (ATM)

FIG. 1 shows an automated teller machine 10. This has a housing 12 with a front fascia 14 that has a screen 16 for presenting financial information to a customer; a keyboard 18 for receiving user inputs; a card slot 20 for receiving a customer's card; a print-out slot 22 through which printed material is dispensed and a slot 24 for dispensing cash through. Included in the ATM housing is a control module 26 that is operable to control access to the banking network and any financial transactions. This includes a control application 27 that is operable to receive user inputs via the keyboard 18 and allow user interaction with the terminal.

Connected to the control module 26 are each of a card reader mechanism 28 that is aligned with the card slot 20, a printer 30 that is aligned with the print out slot 22 and a dispensing mechanism 32 that is aligned with the dispensing slot 24. The card reader mechanism 28 is operable to receive and read cards that are inserted into the slot 20. Information read from the card by the card reader 28 can be transmitted to the control module 26 for further processing. The printer 30 is operable to print out financial information, such as bank statements, under the control of the control module 26. The dispensing mechanism 32 is operable to dispense cash that is stored in a secure enclosure, again under the control of the control module 26.

Figure 2:
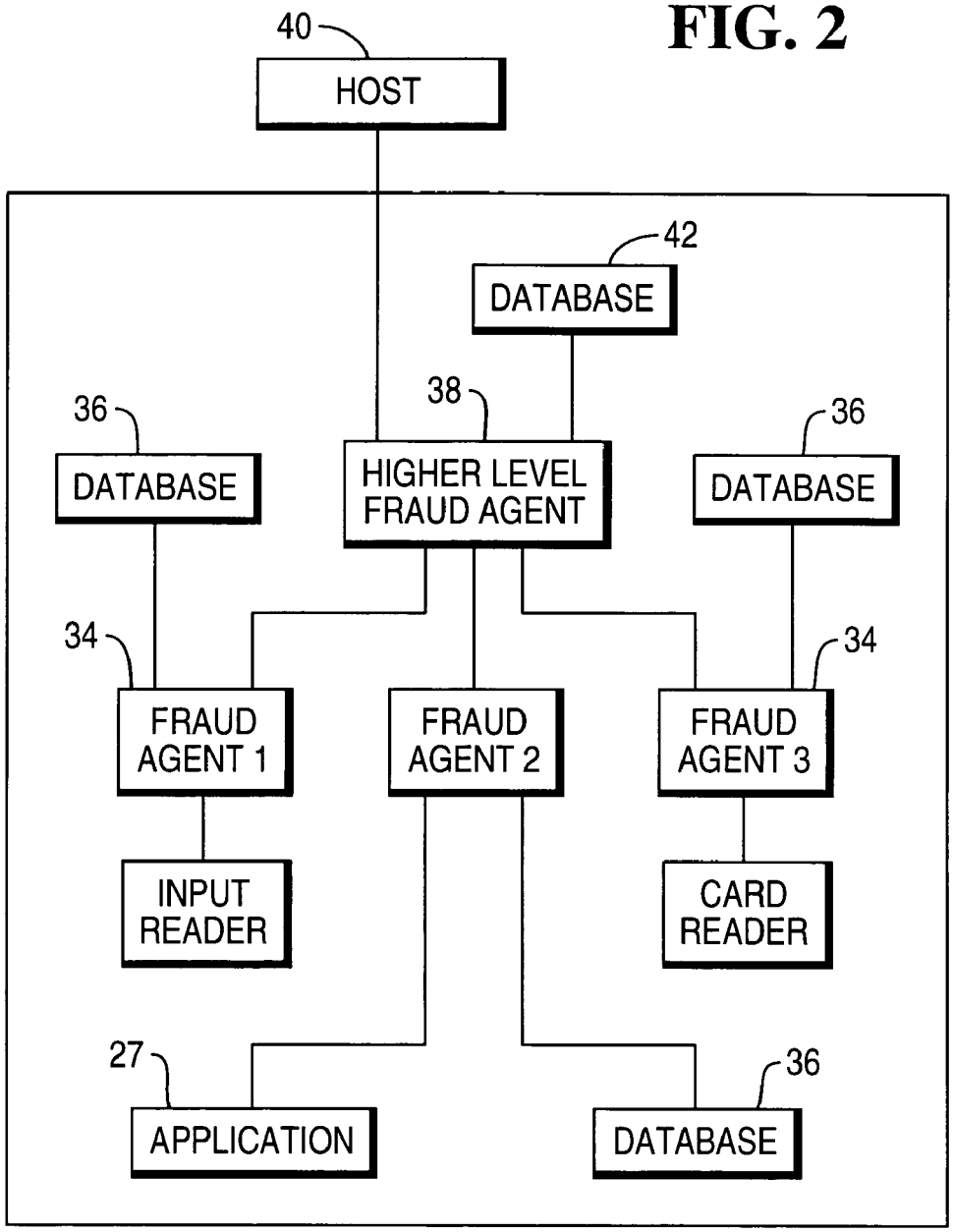
FIG. 2 is a block diagram of a fraud detection system for use in the ATM of FIG. 1.

FIG. 2 shows a fraud detection system for use in the ATM of FIG. 1. This includes a plurality of software agents 34, each one associated with one of the ATM components, such as the keyboard 18, the control application 27 and the card reader 28. Each of the component agents 34 is operable to receive condition signals from sensors (not shown) or some other form of detection mechanism associated with or included in the component, which condition signals are indicative of a certain condition of the relevant component, such as a physical condition or a detected activity. For example, the card reader 28 may include a sensor for identifying if and when the reader is stuck or jammed and/or detecting whether the card inserted is longer or shorter than a standard. Likewise, the application 27 may be operable to identify that the user is at the card entry stage of a transaction and that he is pressing keys on the keyboard. Using this information, the application agent 34 may be operable to deduce that the consumer is attempting to enter a PIN.

Associated with each device-based software agent 34 is a database 36 that includes details of sensor conditions, together with an indication of whether these may imply a potential fraud. Each agent is operable to apply a series of rules that use the condition signals and/or information in the database in order to determine whether a received signal is indicative of a potential fraud attempt. In the event that a signal received from a sensor is indicative of a potential fraud attempt, this could be flagged by the appropriate agent 34 with the following information: a fraud identifier, i.e. a unique identifier for a pre-determined fraud; a fraud type, i.e. a classification of the fraud type; the probability of fraud, i.e. the agent estimate of likelihood that deliberate fraud is occurring and fraud severity, i.e. a classification of the impact of the fraud. Other additional fields that could be used include: a description, i.e. a free-format description of the attempted fraud; a probability that the fraud attempt is an actual fraud, as opposed to merely a device or sensor error; action, e.g. a free-format description of the action that has to be taken at the ATM as a result of the suspected fraud, and source, e.g. a free-format description of the ATM element that has identified the potential fraud—this could hold, for example, the name of the component or application that identified the suspicious device behavior. Each agent is operable to investigate whether received information is indicative of a potential fraud by interrogating its associated database. In the event that it is, a condition or warning signal is constructed by the agent, which signal may include any one of the pieces of information listed above.

Each of the component level agents 34 is operable to communicate with, for example send warning signals to, a higher-level agent 38, which is in turn operable to communicate with the host 40. Associated with the higher-level agent 38 is a database 42 that includes a list of conditions or scenarios that may be indicative of a potential fraud, these being identifiable using information received from the component agents 34. At a low level, this may be a particular sensor pattern from a device. At a higher level, it might be a pattern of fraud events generated by lower level agents.

By using information from a plurality of devices, fraud detection accuracy can be improved. For example, in the event that a signal from the card reader agent indicates that the card reader 28 is jammed, this may suggest that either the card reader 28 is jammed due to a genuine mechanical failure or that it has been forcibly jammed due to attempted fraud. Having only the card reader information makes it difficult to make an effective assessment of the risk. However, using data from two devices can improve this. For example, in the event that the card reader sensor indicates that the card reader 28 is jammed, and then shortly thereafter the control application 27 receives a customer input from the keyboard 18 requesting that a large amount of cash is to be dispensed, this may suggest that a fraudster has tampered with the card reader 28 in some way and is fraudulently trying to extract money from a genuine customer's account. By giving the higher level agent 38 access to information from both the card reader 28 and the control application 27, a more accurate assessment can be made of the likelihood of fraud occurring. As another example, in the event that a card is entered into the card reader 28, but it cannot be read or subsequently ejected or captured, and then the application detects an attempt at PIN entry, this too indicates that it is highly likely that a fraud is occurring. Again, by providing agents 34 associated with each of the reader 28 and the application 27, and causing them to report to a higher-level agent 38, there is provided a more accurate mechanism for assessing the likelihood of fraud.

It should be noted that in each of the examples given above, the application agent 34 provides information relating to the information input by the person interacting with the terminal 10. In the normal course of events, this information would not always be passed to the higher level agent 38 as most transactions will not be attempted frauds. However, the agent 38 may be configured to request this type of information from the application agent 34 in the event that a potential attack on the terminal is detected at one of the other components. Alternatively, the agent 34 may be operable always to broadcast or transmit information relating to suspected frauds and the higher-level agent 38 may be operable to subscribe to this or not, typically depending on whether or not signals from other component agents are indicative of potential frauds.

Figure 3:
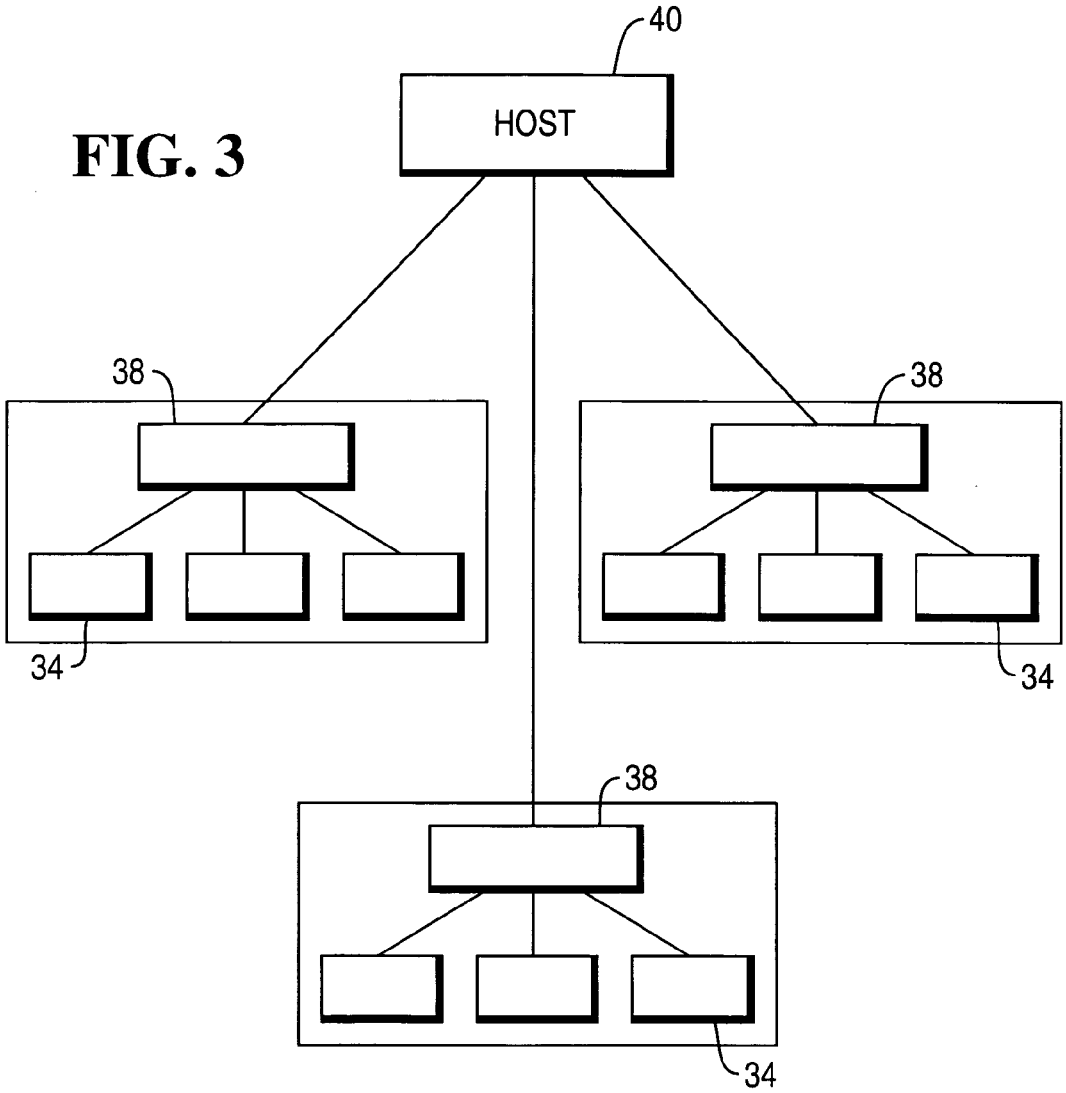
FIG. 3 is a schematic diagram of a network of ATMs that include the fraud detection system of FIG. 2.

In the event that a potentially fraudulent event is detected, the higher level agent 38 can respond in several ways. As a first option, the agent 38 may be operable to cause a signal to be sent to the host 40 identifying the potentially fraudulent activity and seeking instructions on how to proceed. This is useful when ATMs are connected in a network to the same host, as shown in FIG. 3. This is because fraudsters sometimes work in groups, targeting ATMs in a local area. If a plurality of machines report similar problems to the host 40, a group attack on the network can be more readily identified.

Alternatively, the higher level agent 38 may be operable to take remedial action without seeking instructions from the host 40. For example, the agent 38 may be operable to send a signal to the control application 27 to cause the ATM to take appropriate action. For example, this may involve terminating the transaction; capturing the card; ceasing interaction with the user; flashing a warning indication such as an audio or visual indication or any other suitable action. Of course, in these circumstances, the agent 38 and/or the control application 27 would typically cause a signal to be sent to the host 40 indicating what action has been taken and why.

In order to ensure that the system is able to keep up to date with the activities of fraudsters, whose tactics tend to evolve as technology develops, the fraud probability and severity of certain conditions used by the device agents can be re-classified. Typically, this would be done by merely up-dating or including new information in the relevant database 36 or 42. Usually, re-classification would be done based on a range of information, such as details of new tactics being adopted by known fraudsters. Equally, new fraud events or indeed new agents could be introduced. In this way, the system can be adapted easily over time to respond to changing conditions.

A skilled person will appreciate that variations of the disclosed arrangements are possible without departing from the invention. For example, whilst the systems of FIGS. 2 and 3 have two agent levels, it will be appreciated that additional agent levels could be introduced for further refining and classifying fraud attempts. In this case, each component level agent would report to one of a plurality of higher-level agents, and each of the higher-level agents would report to one or more additional agents in the next level of the hierarchy. Each of the agents in the next level up is operable to use information from the lower level agents that report to it, in order to provide an improved assessment of the likelihood of fraudulent activity. Also, whilst the system has been described primarily as a fraud detection system, it could alternatively or additionally be set up to detect acts of vandalism. Furthermore, although some specific device/application conditions have be described for use in identifying fraud, any suitable condition could be used, especially those relating to customer interaction with a terminal. Accordingly, the above description of a specific embodiment is made by way of example only and not for the purposes of limitations. It will be clear to the skilled person that minor modifications may be made without significant changes to the operation described.

What is claimed is:

1. A self-service terminal comprising a first component;

a first storage device for storing information details relating to a number of conditions associated with the first component;

a first low-level software agent for monitoring the first component and providing a first warning signal which is indicative of potentially fraudulent activity occurring at the first component based upon information details stored in the first storage device;

a second component different from the first component;

a second storage device different from the first storage device and for storing information details relating to a number of conditions associated with the second component;

a second low-level software agent different from the first low-level agent and for monitoring the second component and providing a second warning signal which is indicative of a potentially fraudulent activity occurring at the second component based upon information details stored in the second storage device;

a third storage device different from the first and second storage devices and for storing information details relating a number of conditions associated with the self-service terminal; and a high-level software agent for monitoring the first warning signal from the first low-level software agent and the second warning signal from the second low-level software agent and for providing a third warning signal which is indicative of potentially fraudulent activity occurring at the self-service terminal based upon the first and second warning signals and information details stored in the third storage device.

2. A self-service terminal as claimed in claim 1, wherein (i) the first warning signal comprises a characteristic which is indicative of likelihood of deliberate fraudulent activity occurring at the first component, and (ii) the second warning signal comprises a characteristic which is indicative of likelihood of deliberate fraudulent activity occurring at the second component.

3. A self-service terminal as claimed in claim 1, wherein (i) the first warning signal comprises a characteristic which is indicative of severity of potentially fraudulent activity occurring at the first component, and (ii) the second warning signal comprises a characteristic which is indicative of severity of potentially fraudulent activity occurring at the second component.

4. A self-service terminal as claimed in claim 1, wherein (i) the first component comprises a card reader, and (ii) the second component comprises a keyboard.

5. A self-service terminal as claimed in claim 1, wherein (i) the first component comprises a card reader and (ii) the second component comprises a control application.

6. A self-service terminal as claimed in claim 1, wherein (i) the first component comprises a keyboard, and (ii) the second component comprises a control application.

7. A self-service terminal comprising:

a card reader having a card reader mechanism for receiving a card from a user;

a component other than a card reader; and a fraud detection system arranged to detect if a fraudster has tampered with the card reader, the fraud detection system including (i) a first detector arranged to detect jamming of the card reader mechanism, (ii) a second detector arranged to detect a predetermined condition of the component, (iii) a first low-level software agent associated with the card reader and arranged to provide a first warning signal in response to the first detector detecting jamming of the card reader mechanism, (iv) a second low-level software agent associated with the component and arranged to provide a second warning signal in response to the second detector detecting the predetermined condition of the component, and (v) a high-level software agent arranged to provide a third warning signal in response to the first low-level software agent providing the first warning signal and the second low-level software agent providing the second warning signal, the third warning signal being indicative of a fraudster having tampered with the card reader.

8. A self-service terminal as claimed in claim 7, wherein (i) the first warning signal comprises a characteristic which is indicative of likelihood of deliberate fraudulent activity occurring at the card reader, and (ii) the second warning signal comprises a characteristic which is indicative of likelihood of deliberate fraudulent activity occurring at the component which is other than a card reader.

9. A self-service terminal as claimed in claim 7, wherein (i) the first warning signal comprises a characteristic which is indicative of severity of potentially fraudulent activity occurring at the card reader, and (ii) the second warning signal comprises a characteristic which is indicative of severity of potentially fraudulent activity occurring at the component which is other than a card reader.

10. A self-service terminal as claimed in claim 7, wherein the component which is other than a card reader comprises a keyboard.

11. A self-service terminal as claimed in claim 7, wherein the component which is other than a card reader comprises a control application.

12. A method of operating a self-service terminal to detect a fraudster's attempt at the self-service terminal to extract money from a genuine customer's account, the method comprising:

monitoring a first component associated with the self-service terminal and for providing a first warning signal which is indicative of potentially fraudulent activity occurring at the first component based upon information details which relate to a number of conditions associated with the first component and which are stored in a first storage device;

monitoring a second component associated with the self-service terminal and for providing a second warning signal which is indicative of potentially fraudulent activity occurring at the second component based upon information details which relate to a number of conditions associated with the second component and which are stored in a second storage device which is different from the first storage device; and monitoring the first warning signal and the second warning signal and providing a third warning signal in response to the first and second warning signals and information details which are stored in a third storage device which is different from the first and second storage devices, the third warning signal being indicative of a fraudster at the self-service terminal attempting to extract money from a genuine customer's account.

13. A method as claimed in claim 12, wherein (i) the first warning signal comprises a characteristic which is indicative of likelihood of deliberate fraudulent activity occurring at the first component, and (ii) the second warning signal comprises a characteristic which is indicative of likelihood of deliberate fraudulent activity occurring at the second component.

14. A method as claimed in claim 12, wherein (i) the first warning signal comprises a characteristic which is indicative of severity of potentially fraudulent activity occurring at the first component, and (ii) the second warning signal comprises a characteristic which is indicative of severity of potentially fraudulent activity occurring at the second component.

* * * * *